US012550972B1

(12) United States Patent
Hughes et al.

(10) Patent No.: US 12,550,972 B1
(45) Date of Patent: Feb. 17, 2026

(54) FOOTWEAR COMPONENT

(71) Applicant: HBN SHOE, LLC, Salem, NH (US)

(72) Inventors: Brian G. R. Hughes, San Antonio, TX (US); Howard Dananberg, Stowe, VT (US)

(73) Assignee: HBN SHOE, LLC, Salem, NH (US)

( * ) Notice: Subject to any disclaimer, the term of this patent is extended or adjusted under 35 U.S.C. 154(b) by 0 days.

(21) Appl. No.: 19/058,906

(22) Filed: Feb. 20, 2025

(51) Int. Cl.

| | |
|---|---|
| ***A43B 13/12*** | (2006.01) |
| ***A43B 3/12*** | (2006.01) |
| ***A43B 7/14*** | (2022.01) |
| ***A43B 7/144*** | (2022.01) |
| ***A43C 15/16*** | (2006.01) |

(52) U.S. Cl.
CPC ..... *A43B 13/122* (2013.01); *A43B 3/128* (2013.01); *A43B 7/14* (2013.01); *A43B 7/144* (2013.01); *A43C 15/16* (2013.01)

(58) Field of Classification Search
CPC ..... A43B 13/122; A43B 3/0068; A43B 7/14; A43B 7/1425; A43B 7/144; A43B 7/146
USPC ..... 36/11.5, 8.1, 141
See application file for complete search history.

(56) References Cited

U.S. PATENT DOCUMENTS 975,576 A * 11/1910 Sexton ..... A43B 7/144 36/43
1,167,885 A * 1/1916 Carll ..... A43B 7/146 36/32 R
1,746,477 A * 2/1930 Howland ..... A42B 1/12 36/8.1
2,978,818 A * 4/1961 Baumann ..... A43B 17/00 36/145
3,468,040 A * 9/1969 Fukuoka ..... A43B 3/108 36/11.5
3,552,039 A * 1/1971 Fukuoka ..... B29D 35/0018 264/DIG. 83
D241,586 S * 9/1976 Sebestik ..... D2/955
4,112,599 A * 9/1978 Krippelz ..... A43B 13/20 36/3 R
4,759,136 A * 7/1988 Stewart ..... A43B 13/187 36/31
4,910,882 A * 3/1990 Goller ..... A43B 17/00 36/141
5,242,519 A * 9/1993 Wu ..... B32B 38/06 156/154
D352,157 S * 11/1994 Merceron ..... D2/959
5,452,527 A * 9/1995 Gaylord, Jr. ..... A61F 5/0195 36/110
5,694,705 A * 12/1997 Alonso Coves ..... A43B 7/142 36/141
6,178,662 B1 * 1/2001 Legatzke ..... A43B 7/146 36/43
6,604,301 B1 * 8/2003 Manoli ..... A43B 7/223 36/43
6,959,505 B2 * 11/2005 Poe ..... A43B 17/02 36/43

(Continued)

FOREIGN PATENT DOCUMENTS

EP 3381314 A1 10/2018

*Primary Examiner* — Marie D Bays
(74) *Attorney, Agent, or Firm* — HAYES SOLOWAY P.C.

(57) ABSTRACT

An outsole for footwear includes a substrate having an upper surface. A raised grid pattern is formed on the forefoot and rear sections of the substrate upper surface, and a reverse grid pattern is formed on a midsection of the substrate upper surface.

18 Claims, 8 Drawing Sheets

(56) References Cited

U.S. PATENT DOCUMENTS 7,124,520 B2 * 10/2006 Galbraith ..... A43B 17/02 36/43
8,166,674 B2 5/2012 Dananberg
8,769,846 B1 * 7/2014 Williams ..... A43B 7/26 36/141
10,149,512 B1 * 12/2018 Wurtz ..... A43B 7/143
10,702,008 B2 * 7/2020 Hughes ..... A43B 3/12
10,939,724 B2 3/2021 Dodd
2002/0088140 A1 * 7/2002 Wang ..... A43B 5/08 36/141
2004/0261291 A1 * 12/2004 Paek ..... A43B 7/1425 36/43
2005/0115107 A1 * 6/2005 Schumacher ..... A43B 7/1445 36/28
2008/0052966 A1 * 3/2008 Pan ..... B29D 35/122 36/8.1
2008/0110063 A1 * 5/2008 Liu ..... A43B 3/108 36/3 R
2010/0011622 A1 * 1/2010 Abadjian ..... A43B 13/223 36/114
2011/0005102 A1 * 1/2011 Lonsway ..... A43B 3/126 36/94
2011/0023324 A1 * 2/2011 Dananberg ..... A43B 7/1445 36/43
2012/0174439 A1 * 7/2012 O'Connor ..... A43B 5/08 36/11.5
2017/0042284 A1 * 2/2017 Lawless ..... A43B 13/181
2018/0042338 A1 * 2/2018 Orand ..... A43B 13/184
2018/0168278 A1 * 6/2018 Saint Dunbar ..... A43B 7/142
2019/0090583 A1 * 3/2019 Sato ..... A43B 7/1475
2019/0116922 A1 * 4/2019 Wurtz ..... A43B 7/141
2020/0085139 A1 * 3/2020 Izquieta Anaut .... A43B 13/181
2020/0146397 A1 5/2020 Coupe et al.
2020/0268101 A1 * 8/2020 Tu ..... A43B 17/006
2020/0383427 A1 * 12/2020 Mason ..... A43B 7/088
2023/0105107 A1 * 4/2023 Cavaliere ..... A43B 13/12 36/28
2025/0194734 A1 * 6/2025 Bidal ..... A43B 5/001

* cited by examiner

FOOTWEAR COMPONENT

FIELD OF THE DISCLOSURE

The present disclosure is generally related to footwear. The disclosure has particular utility in connection with sports footwear having a hard, one-piece, molded outsole such as a soccer shoe, and will be described in connection with such utility, although other utilities are contemplated.

BACKGROUND OF THE DISCLOSURE

In order to understand the prior art and the present disclosure, it is necessary to understand the anatomy of the foot. FIG. 1A is a diagrammatic side view of the bones of the human foot 110 positioned inside of footwear 130 such as a soccer shoe, in accordance with the prior art. FIG. 1B is a top plan view of the bones of the human foot 110, in accordance with the prior art. For purposes of this application, references to the posterior side mean in the direction of the rear of the foot 110 or heel 112; references to anterior or toes 114 mean in the direction of the front of the foot 110 where the toes 114 or phalanges 116 are located; references to medial mean the inner side of the foot 110, i.e., the side where the big toe or first metatarsal head and the arch 118 are located; references to lateral mean the outside of the foot 110.

With reference to FIGS. 1A-1B, the calcaneus 120 is an irregularly shaped quadrangular bone which is also known as the heel bone. The calcaneus 120 is formed within a group of bones known as the tarsal bones or tarsus 122. The next group of bones, moving anteriorly, are the metatarsals 124. Moving further anteriorly beyond the metatarsals 124 are the phalanges 116. Located at the anterior end of the metatarsal shaft are the metatarsal heads 126A-126E. The metatarsal heads 126A-126E are named according to their corresponding digit, i.e., the metatarsal head 126A corresponding to the phalange 116 of the hallux, more commonly known as the big toe, is the first metatarsal head 126A, while the metatarsal heads 126B-126E correspond to the second through fifth phalanges or digit.

Human footwear 130 has several functions and comes in a great number of varieties. Some footwear 130 is primarily used to support a wearers 132 foot 110. Some footwear 130 is primarily designed for appearance and aesthetics more than for comfort. Other footwear 130 is designed for athletic use. Generally, however, human footwear 130 is designed to protect the foot 110 of the wearer 132. But, as currently designed, footwear may be imperfect in providing proper biomechanical flexible support for the human foot 110.

Thus, a heretofore unaddressed need exists in the industry to address the aforementioned deficiencies and inadequacies.

SUMMARY OF THE DISCLOSURE

Embodiments of the present disclosure provide footwear configured for providing proper biomechanical flexible support for the human foot. Briefly described, in architecture, one embodiment of the system, among others, can be implemented as follows. Footwear has a structural component such as molded outsole which comprises a substrate divided into three sections, a forefoot supporting section configured to underlie the toes or phalanges of a wearer, a midsection configured to underlie the metatarsal heads of a wearer, and a rear section, rearward of the midsection, configured to underlie the arch and the heel of a wearer. The molded outsole component upper surface has a reverse grid lattice section formed on the upper surface of the midsection, and an optional raised grid lattice structure formed on the substrate upper surface forefoot and rear sections.

In one aspect the lattice patterns in the forefoot section and the rear section are similar in plan to one another.

In another aspect, the lattice grid patterns in the forefoot and the rear sections are similar in plan to one another, and are different in plan from the lattice grid pattern in the midsection.

In a further aspect, the lattice grid patterns are square shaped, diamond shaped or hexagonal shaped in plan.

In yet another and preferred aspect the lattice grid patterns are triangular shaped in plan.

In yet another aspect, the midsection includes an area of reduced support configured to underlie the first metatarsal head of the wearer.

In a further aspect, the rear section includes a heel cup configured to underlie the heel of the wearer.

In a further aspect, the footwear is athletic footwear.

The present disclosure can also be viewed as providing methods of forming a footwear product. In this regard, one embodiment of such a method, among others, can be broadly summarized by the following steps: providing footwear component such as a molded outside divided into three sections, a forefoot supporting section configured to underlie the toes or phalanges of a wearer, a midsection configured to underlie the metatarsal heads of a wearer, and a rear section, rearward of the midsection, configured to underlie the arch and the heel of a wearer. The molded outsole component upper surface has a reverse grid lattice section formed on the upper surface of the midsection, and a raised grid lattice structure formed on the substrate upper surface forefoot and rear sections.

In one aspect of the method, the footwear component is formed by injection molding.

In another and alternative aspect of the method, the footwear component is formed by additive manufacturing.

In another aspect of the method, the lattice grid patterns in the forefoot and the rear sections are formed similar in plan to one another, and are different in plan from the lattice grid pattern in the midsection.

In a further aspect of the method, the lattice grid patterns are square shaped, diamond shaped or hexagonal shaped in plan.

In yet another and preferred aspect of the method, the lattice grid patterns are triangular shaped in plan.

In yet another aspect of the method, the midsection includes an area of reduced support configured to underlie the first metatarsal head of the wearer.

In a further aspect of the method, the rear section includes a heel cup configured to underlie the heel of the wearer.

In a further aspect of the method, the footwear is athletic footwear.

According to aspect A of the disclosure there is provided an outsole for footwear, comprising: a substrate having an upper surface divided into a forefoot section configured to underlie the toes or phalanges of a wearer; a midsection configured to underlie the metatarsal heads of the wearer; and a rear section configured to underlie the arch and heel of the wearer; a reverse grid pattern on the midsection of the substrate upper surface and a raised grid pattern formed on the forefoot and the rear section or substrate upper surface.

In one embodiment of Aspect A the rear section has a concave recess configured to underlie a calcaneus of the wearer.

In another embodiment of Aspect A the midsection has a concave recess configured to underlie a first metatarsal head of the wearer.

In a further embodiment of Aspect A, at least a portion of the raised grid pattern and/or the reverse grid pattern has a triangular grid pattern.

In still another embodiment of Aspect A the outsole is in the form of an unitary molded construction.

In yet another embodiment of Aspect A, the substrate upper surface is formed as a laminated construction.

According to Aspect B of the disclosure there is provided a footwear product comprising an outsole as above described according to Aspect A, as a structural element.

In one embodiment of Aspect B, the footwear product comprises a sports shoe.

In a particular embodiment of Aspect B, the shoe comprises a cleated or spiked sports shoe.

In yet another embodiment of Aspect B the footwear product comprises a non-cleated or non-spiked footwear product.

In still another embodiment of Aspect B, the footwear product comprises a molded footwear product.

In a particular embodiment of Aspect B, footwear product comprises a molded sandal or a flip-flop.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
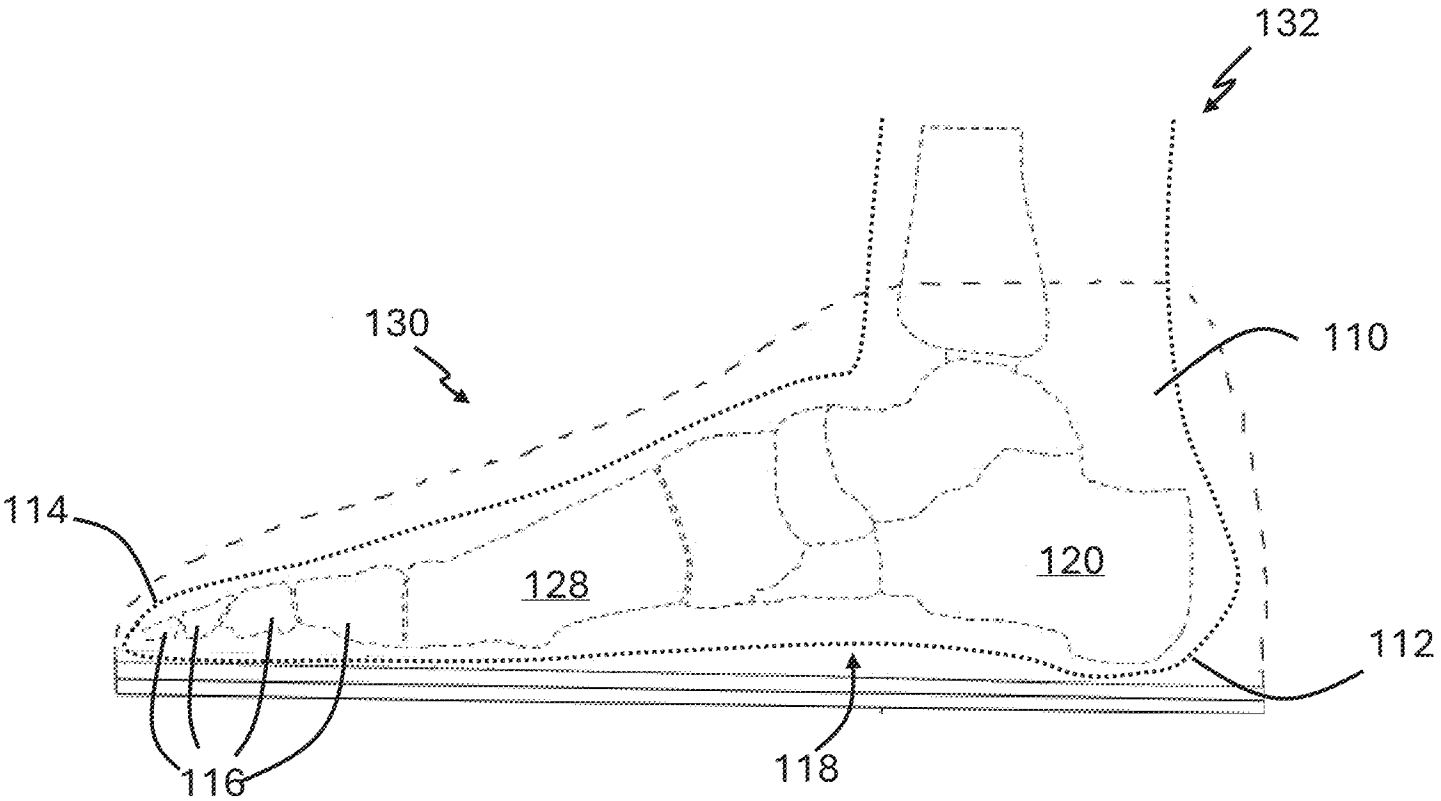
FIG. 1A PRIOR ART
FIG. 1A is a diagrammatic side view of bones of a human foot positioned inside of footwear, in accordance with the present disclosure.
Figure 1B:
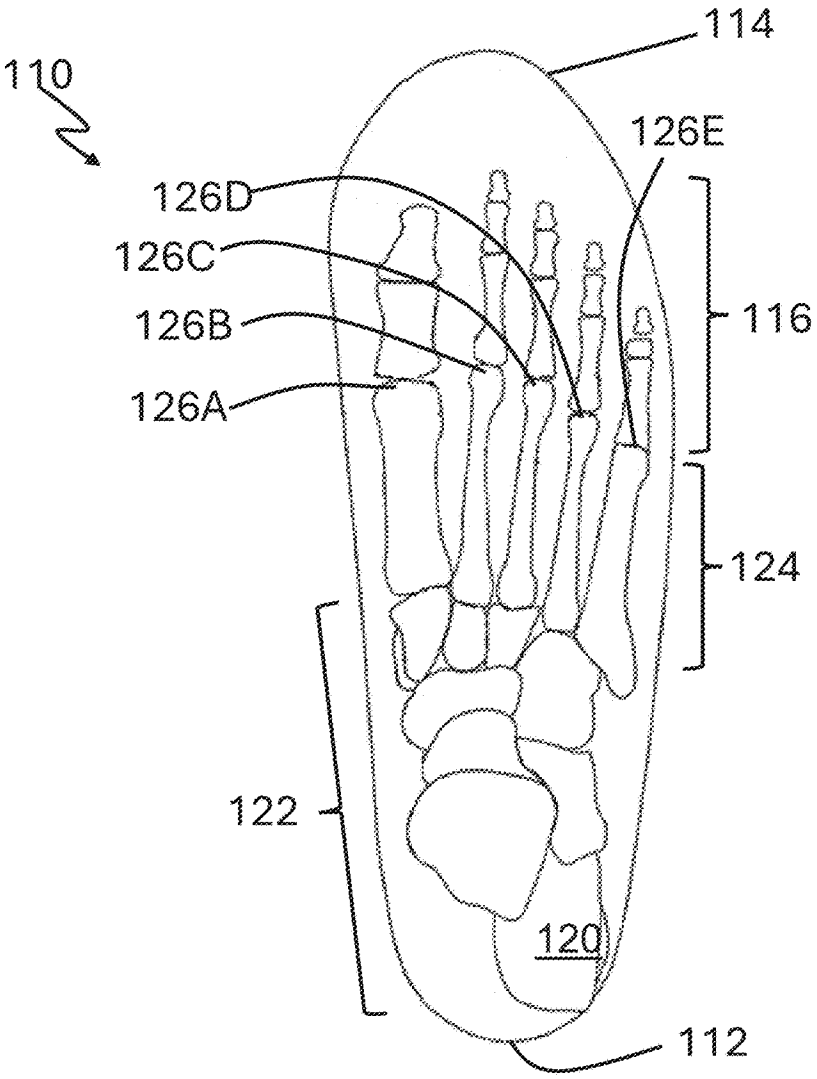
FIG. 1B PRIOR ART
FIG. 1B is a top plan view of the bones of a human foot, positioned in a shoe, in accordance with the prior art.

As used herein the term "grid" refers to a structure or pattern of regularly spaced lines crossing each other to form geometric patterns. As used herein a "raised grid pattern" has raised lines defining recessed portions, while a "reverse grid pattern" has recessed lines defining raised land portions.

Referring to FIGS. 2, 3A, 3B and 5, there is shown footwear 30 in the form of a soccer shoe having a footwear component in the form of a molded outsole 34 made in accordance with the present disclosure. Molded outsole 34 comprises a substrate 36 having a forefoot section 46, a midsection 40 and a rear section 48. Open positive or raised grid patterns 60, 62 are formed in an upper surface 38 of the forefoot section 46 and the rear section 48 of substrate 36, and a reverse grid pattern 56, 58 is formed in the midsection 40 of the substrate 36 upper surface 38. A medial region of the midsection 40 has a concave area 44 configured to underlie a first metatarsal head 126A of a wearer. Concave area 44 is formed in accordance with the teachings of our prior U.S. Pat. No. 8,166,674, the contents of which are incorporated herein by reference, and preferably is about 1 to 2.5 mm deep. A concave heel cup 52 configured to underlie the heel bone or calcaneus 120 of a wearer, is formed in the top surface of rear section 48 in accordance with the teachings of our prior U.S. Pat. No. 10,702,008, the contents of which are incorporated herein by reference.

Footwear 30 is illustrated as a soccer shoe. However, footwear 30 may comprise other types of footwear including but not limited to sports footwear including cleated footwear such as soccer cleats, baseball cleats, football cleats, rugby cleats, cricket shoes, golf shoes, or non-cleated or non-spiked sports footwear such as basketball shoes, tennis shoes, futsal shoes, and the like. Footwear 30 also may comprise non-sports footwear such as sandals, flip-flops, shoes and boots.

Substrate 36 upper surface 38 may be formed directly as a foot supporting surface of footwear 30, by injection molding or by additive manufacturing. Alternatively, a top element having a grid pattern may be separately formed and adhered or joined to a lower supporting element or substrate to form component 36.

As noted supra, upper surface 38 of molded outsole 34 has the reverse grid pattern in the midsection 40, which includes a grid pattern formed on the substrate 36 upper surface 38. Each individual unit of the grid pattern in midsection 40 has protrusions or lands 56 which extend from the substrate 36. A plurality of protrusions or lands 56 are separated by a plurality of interconnected channels 58 in a grid pattern.

Midsection 40 on the upper surface 38 of the molded outsole 34 is located to underlie the metatarsal heads 26A-26E of the foot 10 of the wearer 32. A concave recess 44 is formed on a medial region 42 of the molded outsole 34. Concave recess 44 is configured to substantially underlie the first metatarsal head 26A of the foot of the wearer 32. Concave recess 44 may have a smooth surface void of protrusions in order to maintain required thickness for structural integrity. Concave recess 44 provides an area of reduced support relative to the remainder of the midsection 40 of the molded outsole so as to promote eversion of the first metatarsal head as the wearer moves from midstance through propulsive phase as taught by our aforesaid prior US U.S. Pat. No. 8,166,674.

The upper surface 38 of the forefoot section 46 of molded outsole 34 has a positive grid pattern formed on the substrate 36 upper surface 38, which is configured to underlie phalanges 16 of the foot of the wearer 32.

The rear section 48 of upper surface 38 of the molded outsole 34 has a positive grid pattern 60, 62, formed on the substrate 36 upper surface 38. Features and details of the positive grid pattern of the rear section 48 may be the same or similar to the positive grid pattern of the forefoot section 46, or may be different.

The positive grid pattern 60, 62 of rear section 48 may be positioned on the upper surface 38 of molded outsole 34 to substantially correspond with the positioning of the arch and heel bone or calcaneus 20 of the foot 10 of the wearer 32. A concave depression 52 is provided on the rear region 48 of the molded outsole 34, configured to substantially underlie the heel bone or calcaneus 20 of the foot 10 of the wearer 32. The concave depression 52 may have a smooth surface in order to maintain required thickness for structural integrity.

As will be demonstrated and discussed below, by providing a positive grid pattern structure on the upper surface forefoot section 46 and rear section 48, and a reverse grid pattern on the upper surface of the midsection 40 of the molded outsole 34, the midsection 40 of the molded outsole 34 becomes significantly more flexible than the forefoot section 46 or the rear section 48. As a result, the footwear bends under the metatarsals of the wearer upon toe off, substantially improving the comfort of the shoe and also reducing potential injury for the wearer. This bending phenomenon is unexpected since simply providing a positive grid pattern on the entire upper surface of the outsole there would be no difference in flexibility of the outsole at any point. Also, if we were to reverse the grid patterns, i.e., by providing reverse grid patterns in the forefoot and rear section of the outsole, and providing a positive grid pattern in the midsection, i.e., configured to underlie the wearer's metatarsal heads, the flexibility of the outsole under the wearer's metatarsal heads would be reduced adding to discomfort and potential injury to the wearer.

Molded outsole 34 also has a perimeter sidewall 72, which extends past the upper surface 38 and around the entirety of a perimeter of the substrate 36. The perimeter sidewall 72 may be a continuation of the material of the molded outsole 34.

Figure 2:
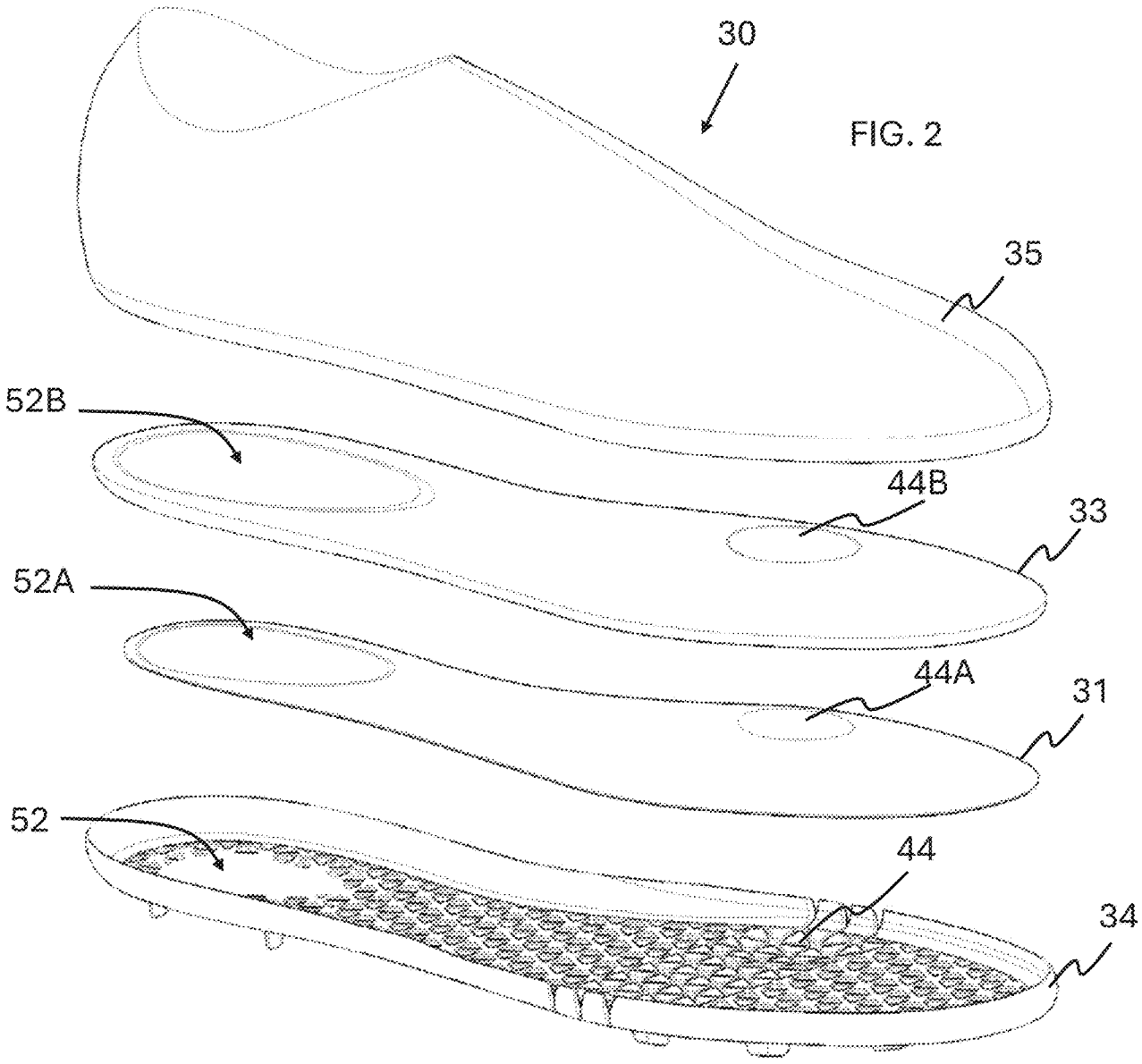
FIG. 2 is an exploded view of a footwear product such as a soccer shoe having a molded outsole, in accordance with the present disclosure.

Completing footwear 30 are a Strobel Board or midsole 31, an insole 33, and a boot 35. As seen in FIG. 2, the Stroble Board or midsole 31 and the insole 33 each have concave areas or recesses 44A, 44B configured to overlie outsole recess 44 in their respective midsections, and recesses 52A, 52B configured to overlie outsole recess 52 in their respective rear sections.

To test flexibility, four different sample outsoles were tested.

Figure 4B:
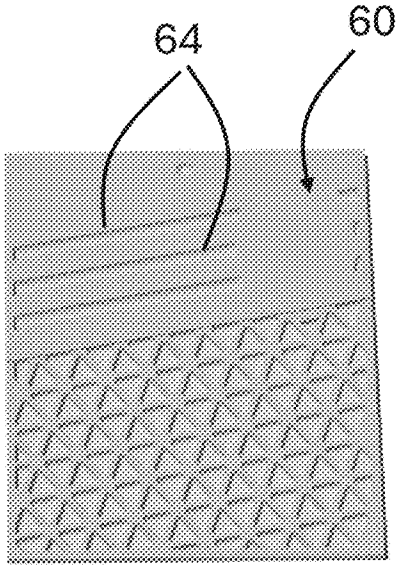
FIGS. 4A-4D are perspective views of midsection portions of a molded outsole in accordance with the present disclosure.
Figure 4D:
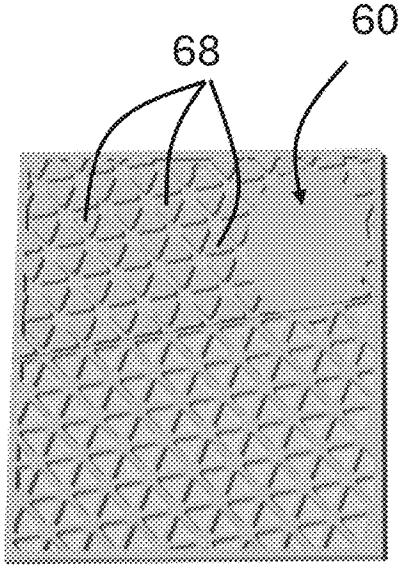
Figure 4A:
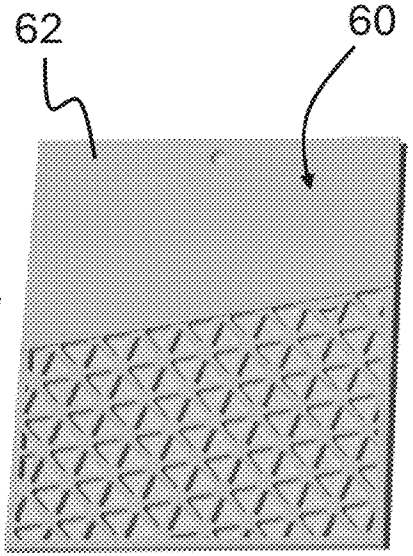
Figure 4C:
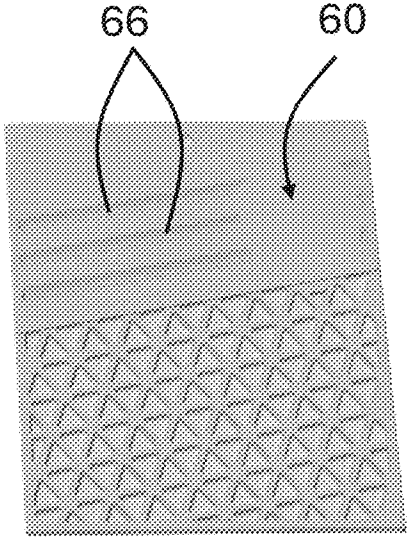
Figure 5:
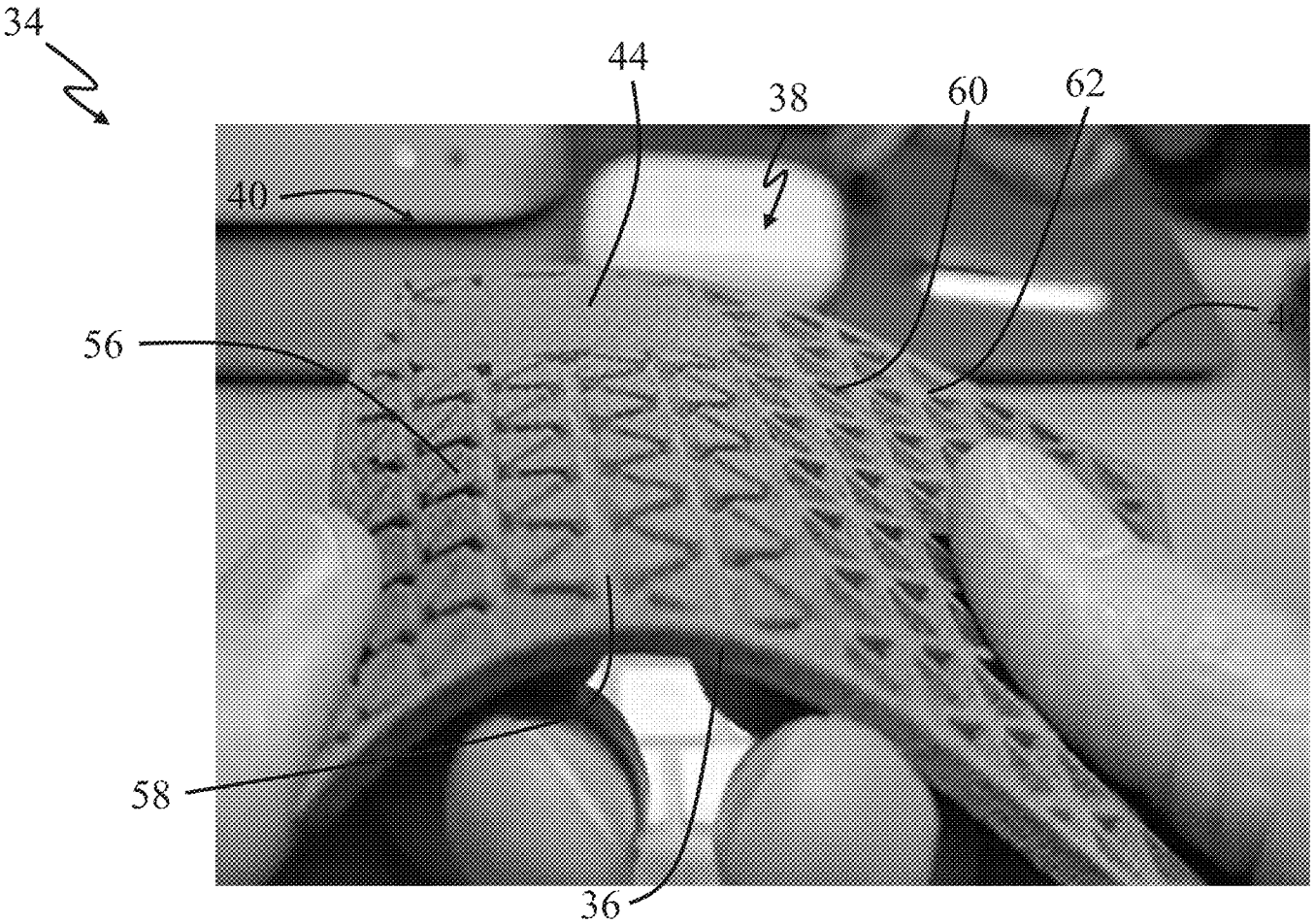
FIG. 5 is a perspective view illustrating comparative flexibility of a midsection portions of various molded outsole components.

FIGS. 4A-4D are diagrammatic view illustrations of the midsection portions of molded outsoles 34 made with four different surface patterns. FIG. 4A illustrates a "control" molded outsole where the midsection has a depression 60 configured to underlie the first metatarsal head of the wearer, the remainder 62 of the area being a solid surface. FIG. 4B illustrates a molded outsole which includes a depression 60 configured to underlie the first metatarsal head, and a plurality of half cylinder flex lines 64 configured to underlie the $2^{nd}$ to $5^{th}$ metatarsal heads of the wearer. FIG. 4C is similar to FIG. 4B, but the flex lines 66 underlying the $2^{nd}$ to $5^{th}$ metatarsal heads of the wearer are triangular in shape. And, FIG. 4D includes a depression 60 configured to underlie the first metatarsal head, and a reverse grid 68 pattern configured to underlie the $2^{nd}$ to $5^{th}$ metatarsal heads of the wearer. The outsoles of FIGS. 4A-4D were clamped on one edge, a spring scale attached to an opposite edge, the samples were bent, and the force recorded to bend the samples equally were recorded. The force to bend each sample 10 mm is set forth in Table I below:

TABLE I

| Sample No. | Force to bend 10 mm |
|---|---|
| A | 330 grams |
| B | 200 grams |
| C | 270 grams |
| D | 140 grams |

Unexpectedly, the outsole having a reverse grid pattern was far superior in terms of flexibility. Moreover, on reversing the bending force, the outsole having a reverse grid pattern bent equally well inside and out, i.e., in either direction.

Another feature and advantage that comes from providing outsole with grid patterns in accordance with the present disclosure is that less material is needed to form the outsoles, and the weight of the footwear is reduced.

Figure 6B:
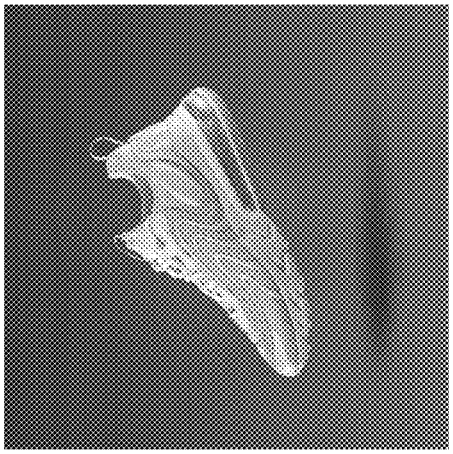
FIGS. 6A-6C illustrates other types of footwear products incorporating a made in accordance with the present disclosure.
Figure 6A:
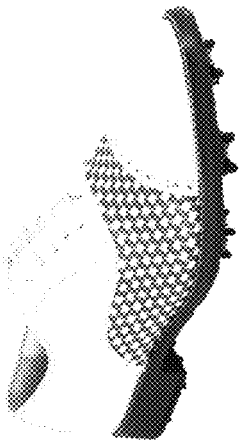
Figure 6C:
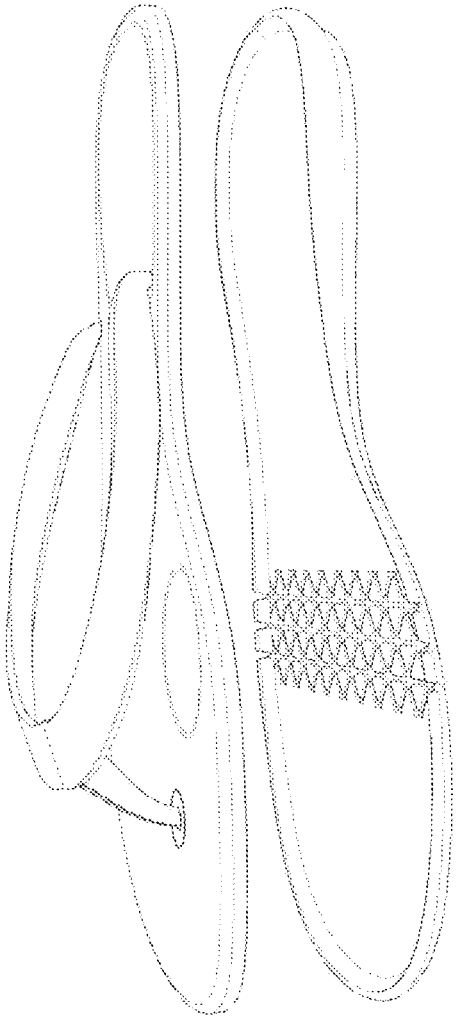

FIG. 6A-6C illustrates non-limiting examples of various types of footwear that may be formed in accordance with the present disclosure including other forms of cleated shoes (FIG. 6A) such as golf shoes, cricket shoes and the like, non-cleated shoes (FIG. 6B) such as sneakers, boots, basketball shoes and the like, as well as molded sandals and flip-flops (FIG. 6C).

Figure 3A:
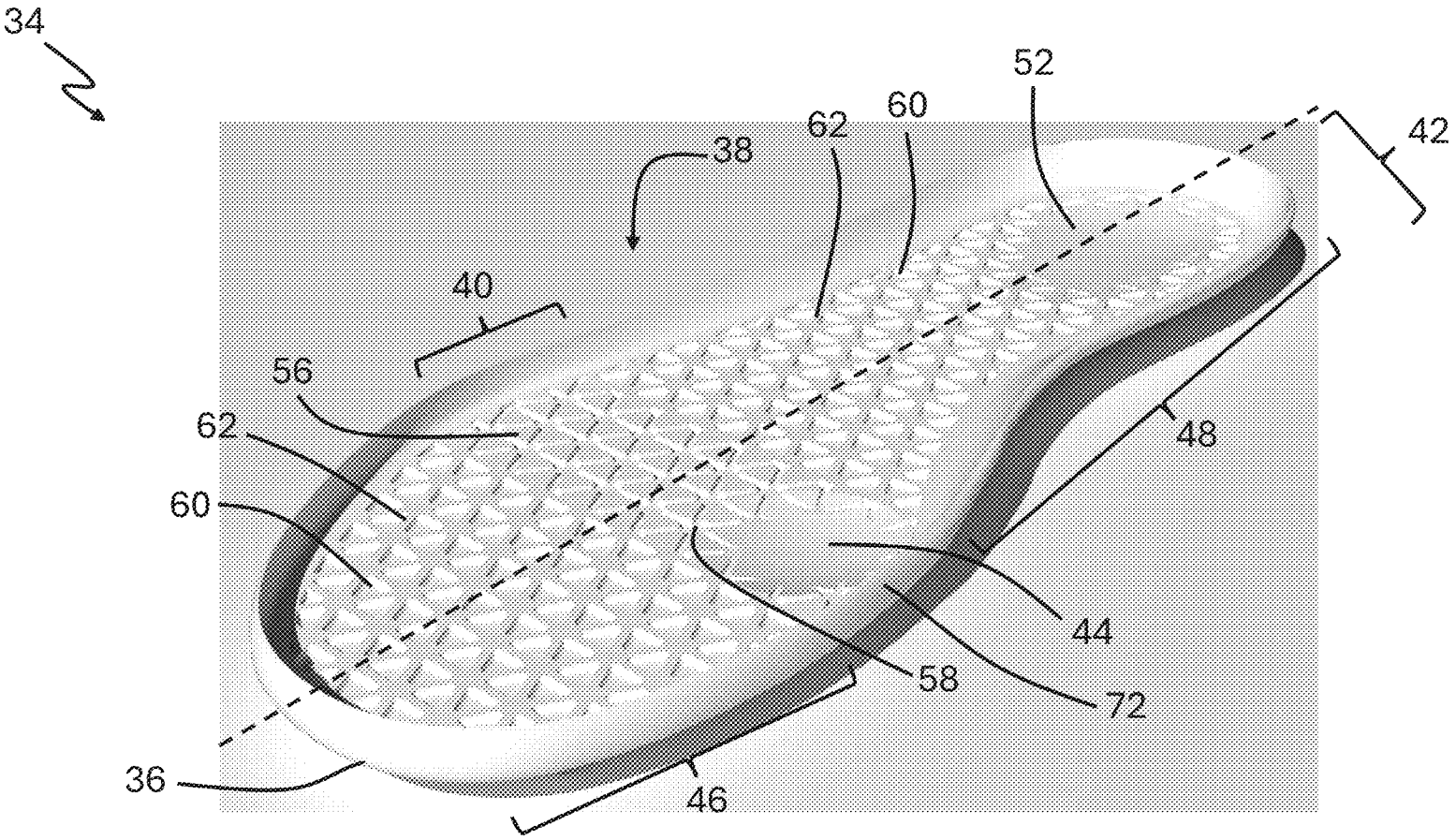
FIG. 3A is a perspective view of the molded outsole of FIG. 2, in accordance with the present disclosure.
Figure 3B:
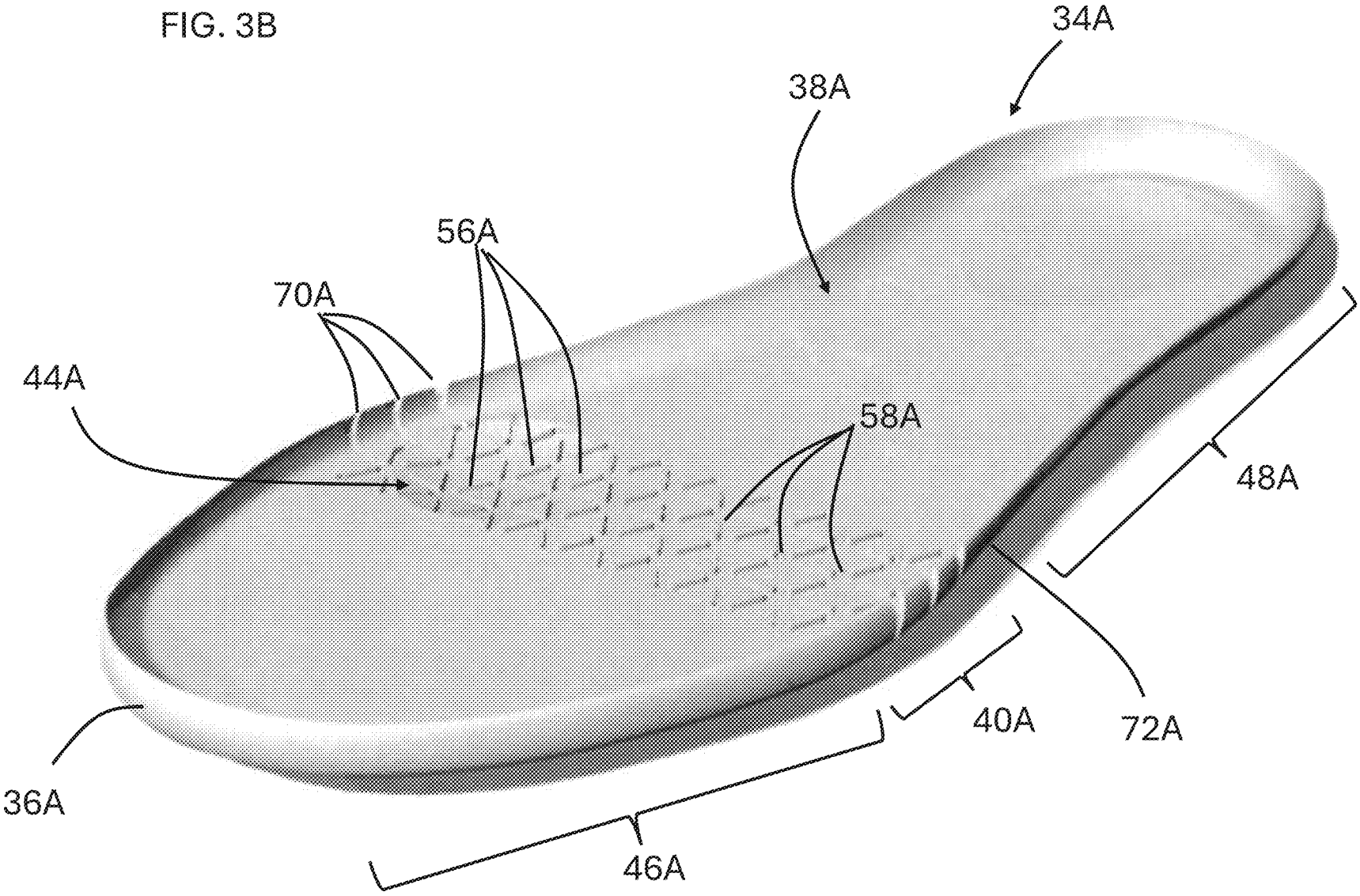
FIG. 3B is a view similar to FIG. 3A of an alternative embodiment of a molded outsole in accordance with the present disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. By way of example, as illustrated in FIG. 3B, a molded outsole 34A may have a reverse grid pattern formed on the upper surface 38A of the outsole midsection 40A, formed by a plurality of lands 56A which extend from the substrate 36A, separated by a plurality of interconnected channels 58A in a grid pattern, while the remainder of the upper surface 38A of the outsole 34A, i.e., forefoot and rear sections 46A, 48A, are smooth. Molded outsole 34A also may include flex notches or perforations 70A in a side wall 72A of the molded outsole 34A that align with the channels 58A of the reverse grid pattern, and a concave recess 44A configured to substantially underlie the first metatarsal head 26A of the foot of the wearer 32. All such modifications and variations are intended to be included herein within the scope of this disclosure and the present disclosure and protected by the following claims.

What is claimed is:

1. An outsole for footwear, comprising:

a substrate having an upper surface divided into a forefoot section configured to underlie the toes or phalanges of a wearer;

a midsection configured to underlie the metatarsal heads of the wearer; and a rear section configured to underlie the arch and heel of the wearer;

a reverse grid pattern on the midsection of the substrate upper surface, and a raised grid pattern formed on the forefoot and the rear section of the substrate upper surface, wherein the midsection upper surface has a concave recess 1 to 2.5 mm deep, configured to underlie a first metatarsal head of the wearer whereby to promote eversion of the first metatarsal head of the wearer.

2. The outsole of claim 1, wherein at least a portion of the raised grid pattern and/or the reverse grid pattern has a triangular grid pattern.

3. The outsole of claim 1, in the form of an unitary molded construction.

4. The outsole of claim 1, wherein the substrate upper surface is formed as a laminated construction.

5. A footwear product, comprising an outsole as claimed in claim 1.

6. The footwear product of claim 5, wherein the footwear product comprises a non-cleated or non-spiked sports shoe selected from the group consisting of a basketball shoe, a tennis shoe, a sneaker and a futsal shoe.

7. The footwear product of claim 5, wherein the footwear product comprises a cleated or spiked sports shoe, selected from the group consisting of a soccer shoe, a baseball shoe, a football shoe, a rugby shoe, a cricket shoe and a golf shoe.

8. The footwear product of claim 5, wherein the footwear product comprises a sandal or a flip-flop.

9. The outsole of claim 1, wherein the midsection concave recess has a depth of 1 to 2.5 mm.

10. The outsole of claim 1, wherein the outsole includes one or more flex notches formed in a sidewall of the outsole, aligned with channels of the reverse grid pattern on the midsection of the upper surface of the substrate.

11. An outsole for footwear, comprising:

a substrate having an upper surface divided into a forefoot section configured to underlie the toes or phalanges of a wearer;

a midsection configured to underlie the metatarsal heads of the wearer; and a rear section configured to underlie the arch and heel of the wearer;

a reverse grid pattern on the midsection of the substrate upper surface, and a raised grid pattern formed on the forefoot and the rear section of the substrate upper surface, and wherein the outsole includes one or more flex notches formed in a sidewall of the outsole, aligned with channels of the reverse grid pattern on the midsection of the upper surface of the substrate.

12. The outsole of claim 11, wherein at least a portion of the raised grid pattern and/or the reverse grid pattern has a triangular grid pattern.

13. The outsole of claim 11, in the form of an unitary molded construction.

14. The outsole of claim 11, wherein the substrate upper surface is formed as a laminated construction.

15. A footwear product, comprising an outsole as claimed in claim 11.

16. The footwear product of claim 15, wherein the footwear product comprises a non-cleated or non-spiked sports shoe selected from the group consisting of a basketball shoe, a tennis shoe, a sneaker and a futsal shoe.

17. The footwear product of claim 15, wherein the footwear product comprises a cleated or spiked sports shoe selected from the group consisting of a soccer shoe, a baseball shoe, a football shoe, a rugby shoe, a cricket shoe and a golf shoe.

18. The footwear product of claim 15, wherein the footwear product comprises a sandal or a flip-flop.

* * * * *